US006038869A

United States Patent [19]

Lee et al.

[11] Patent Number: 6,038,869

[45] Date of Patent: Mar. 21, 2000

[54] METHOD AND APPARATUS FOR MAKING SPHERICAL ICE PARTICLES

[75] Inventors: Yoon Pyo Lee; Chun Sik Lee; Kwang Ho Kim; Jong Soo Jurng; Young Il Kim; Hung Tae Shin, all of Seoul; Hee Suk Han, Soowon-si, all of Rep. of Korea

[73] Assignee: Korea Institute of Science and Technology, Seoul, Rep. of Korea

[21] Appl. No.: 09/181,921

[22] Filed: Oct. 29, 1998

[30] Foreign Application Priority Data

Oct. 31, 1997 [KR] Rep. of Korea ..... 97-57006

[51] Int. Cl.[7] ..... F25B 19/00

[52] U.S. Cl. ..... 62/100; 62/268

[58] Field of Search ..... 62/100, 169, 268, 62/270

[56] References Cited

U.S. PATENT DOCUMENTS

| | | | |
|---|---|---|---|
| 828,888 | 8/1906 | Hoofnagle | 62/268 |
| 2,100,151 | 11/1937 | Tietz | 62/268 |
| 2,387,921 | 10/1945 | MacDonald | 62/268 |
| 2,507,632 | 5/1950 | Hickman | 62/100 |
| 2,621,492 | 12/1952 | Beardsley et al. | 62/270 |
| 2,913,883 | 11/1959 | Burgess | 62/268 |
| 3,210,861 | 10/1965 | Eolkin | 62/100 |
| 3,423,950 | 1/1969 | Reynolds | 62/268 |
| 4,845,954 | 7/1989 | Johansson | 62/100 |
| 5,157,929 | 10/1992 | Hotaling | 62/100 |

OTHER PUBLICATIONS

J. Paul, International IIF/IIR Conference (New Applications of Natural Working Fluids in Refrigeration and Air–Conditioning), pp. 97–107, "Water as Alternative Refrigerant", May, 1994.

T. Ibamoto, Air Conditioning Sanitary Engineering, vol. 64, No. 6, pp. 11–19, "Classification of Ice Storage System", (with English Synopsis), Jun., 1990.

*Primary Examiner*—William E. Tapolcai

*Attorney, Agent, or Firm*—Oblon, Spivak, McClelland, Maier & Neustadt, P.C.

[57] ABSTRACT

A method and apparatus for generating uniformly sized spherical ice particles. The apparatus comprises a water feed pump, a vacuum chamber connected to the water feed pump and having a water spray nozzle, boosters discharging the vapor from the vacuum chamber to maintain the inside of the vacuum chamber below a desired pressure and compressing it, a condenser for condensing the vapor being compressed by the boosters, and a vacuum pump for removing noncondensable gases from the condenser. The method comprises the steps of decreasing the pressure of the vacuum chamber below the first pressure, feeding water from the water source to the spray nozzle of the vacuum chamber, making spherical ices by spraying the water being fed from the nozzle into the inside of the vacuum chamber, in which the size of the droplets being sprayed is below a desired size, during said ice making step, maintaining the pressure of the vacuum chamber below the second pressure by discharging the vapor from the vacuum chamber and compressing the vapor to increase its saturation temperature above room temperature, condensing the compressed vapor within the condenser using water at room temperature as coolant, and draining the water being condensed during the condensing step and removing noncondensable gases.

8 Claims, 3 Drawing Sheets

METHOD AND APPARATUS FOR MAKING SPHERICAL ICE PARTICLES

BACKGROUND OF THE INVENTION

1. Field of the Invention

This invention generally relates to a method and apparatus for making ice and, in particular, to a method and apparatus for making uniformly sized spherical ice particles.

2. Description of the Prior Art

A mixture of ice particles and cold water may be used as a cold heat transport material in a closed loop cooling system in which the ice particles, which effectively fulfill the thermal transport function of the material, are transported through the cooling system by the water. A drawback of using such a material is that the ice particles, which are typically of nonuniform shape and size, are prone to agglomerate as they pass through the heat exchanger of the cooling system, especially where the diameter of the heat exchanger tubing has been minimized in order to increase the heat transfer efficiency of the exchanger.

Conventional methods for generating ice particles include: indirect-contact methods, in which the ice particles are generated by indirectly contacting the refrigerant with brine; direct-contact methods, in which the ice particles are generated by directly contacting the refrigerant with brine; and vacuum methods.

The conventional indirect-contact ice-making apparatus shown schematically in FIG. 1 comprises: a refrigerant storage container (2), generally an annular cylinder, which has a refrigerant feed port (4) at its top and a refrigerant discharge port (12) at its bottom; a brine flow pipe (8), generally a cylinder coaxial with the annular cylinder, which is enveloped by and in good thermal contact with the refrigerant storage container; an expansion valve (6) which connects a refrigerant source (not shown), generally above the storage container (2), and the refrigerant feed port (4); and a compressor/condenser (not shown), generally below the storage container, which is connected to the discharge port (12).

Refrigerant in the indirect-contact ice-making apparatus described immediately above flows in a closed loop from the refrigerant source through the expansion valve (8), which allows the refrigerant to expand, to the refrigerant storage container (2), and from the refrigerant storage container (2) through the compressor/condenser, which compresses and condenses the refrigerant, back to the refrigerant source. While passing through the brine flow pipe (8), low density brine is cooled by indirect contact with the refrigerant through the walls of the brine flow pipe and is thereby converted into a mixture of high density brine and the ice particles.

The direct-contact ice-making apparatus shown schematically in FIG. 2 comprises: a refrigerant storage container (20), which has a refrigerant feed port (24) at its bottom and a refrigerant discharge port (22) at its top; an expansion valve (26) which connects a refrigerant source (not shown), generally below the storage container, and the refrigerant feed port (24); and a condenser/compressor (not shown), generally above the storage container, which is connected to the discharge port (22).

Refrigerant in the direct-contact ice-making apparatus described immediately above flows in a closed loop from the refrigerant source (not shown) through the expansion valve (26), which allows the refrigerant to expand, into the refrigerant storage container (28), and from the refrigerant storage container (28) through the compressor/condenser (not shown), which compresses and condenses the refrigerant, back to the refrigerant source. While passing through the refrigerant storage container (28), low density brine is cooled by direct contact with the refrigerant and is thereby converted into a mixture of high density brine and ice particles.

In both the indirect-contact and the direct-contact ice-making methods described above, the brine and the ice particles must be separated after ice particles have been formed. Further, both methods typically use refrigerants, such as freon, which adversely affect the environment.

In the vacuum ice-making method illustrated in FIG. 3, ice is formed by filling part of a vacuum chamber with water and then decompressing the vacuum chamber. Since the layer of ice thereby formed at the bottom of the vacuum chamber must be pulverized in order to form ice particles, the vacuum ice-making method does not yield uniformly sized, spherical ice particles.

SUMMARY OF THE INVENTION

According to one aspect of the present invention, an apparatus for making spherical ice particles is provided, which comprises: a water feed pump; a vacuum chamber having at least one nozzle inside thereof, said nozzle connected to said water feed pump for spraying water droplets; at least one booster connected to said vacuum chamber for discharging water vapor vaporized from the water droplets in the vacuum chamber and for compressing the discharged water vapor, thereby maintaining a predetermined pressure within the vacuum chamber; a condenser for condensing the water vapor compressed by said booster, and a vacuum pump connected to said condenser for removing noncondensable gases from the condenser.

According to one aspect of the present invention, a method for making spherical ice particles is provided, which comprises the steps of: reducing pressure within a vacuum chamber below a predetermined pressure; feeding water from a water source to at least one spraying nozzle within an upper portion of said vacuum chamber, thereby generating water droplets having diameters less than a predetermined diameter, and water vapor which vaporizes from the water droplets and has a saturation temperature; discharging water vapor from the vacuum chamber, thereby maintaining pressure within said vacuum chamber below the predetermined pressure; compressing the discharged water vapor, thereby increasing the saturation temperature of vapor above room temperature; condensing the compressed water vapor within a condenser at room temperature using water as a coolant; and draining the water being condensed during the condensing step and removing noncondensable gases.

DESCRIPTION OF THE PREFERRED EMBODIMENTS

Figure 1:
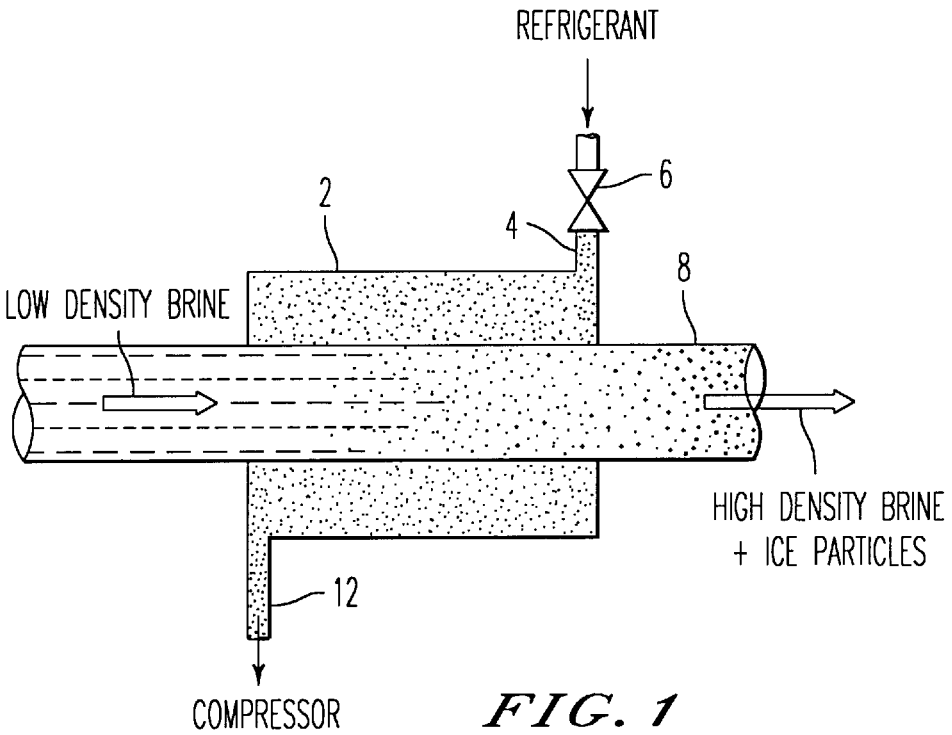
FIG. 1 PRIOR ART
FIG. 1 is a schematic of a conventional indirect-contact ice-making apparatus.
Figure 2:
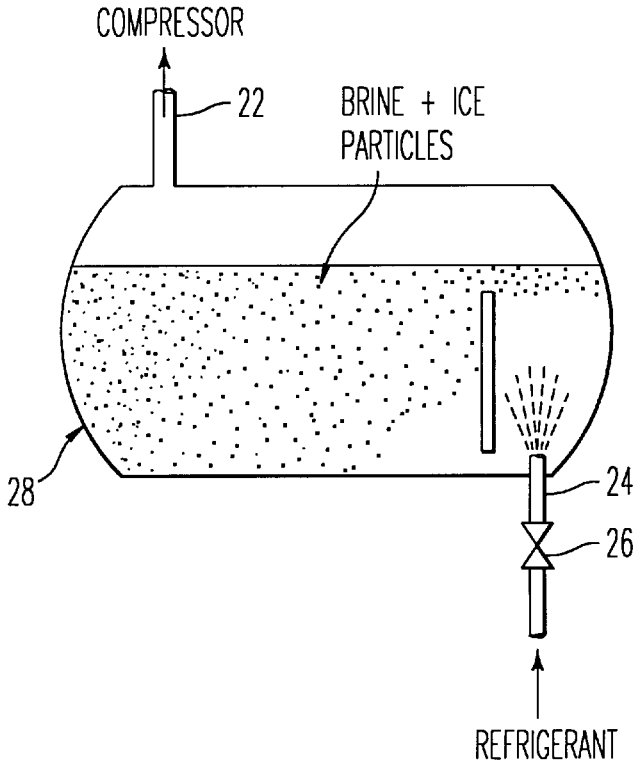
FIG. 2 PRIOR ART
FIG. 2 is a schematic of a conventional direct-contact ice-making apparatus.
Figure 3:
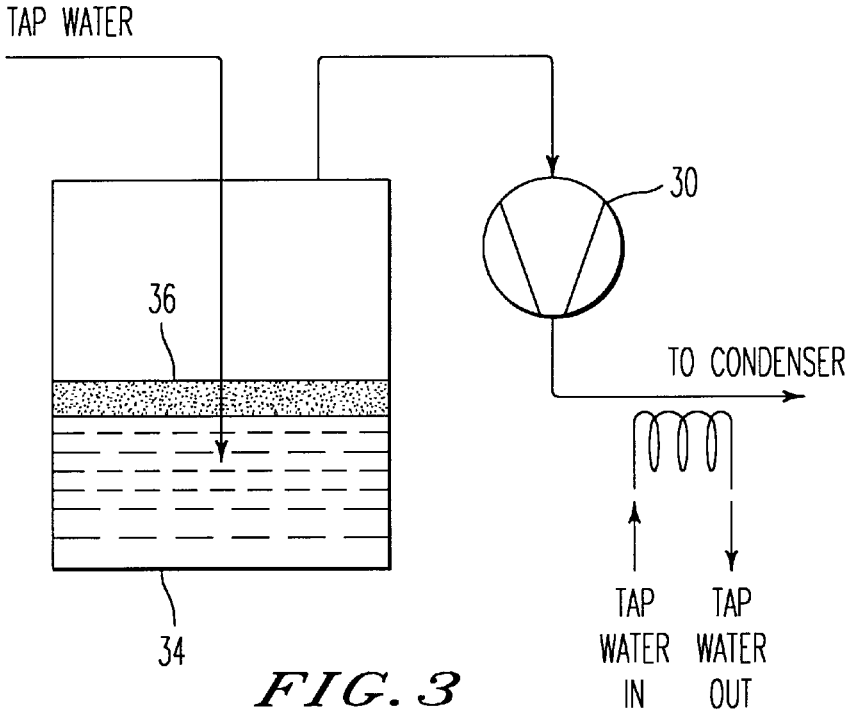
FIG. 3 PRIOR ART
FIG. 3 is a schematic of a conventional vacuum ice-making apparatus.
Figure 4:
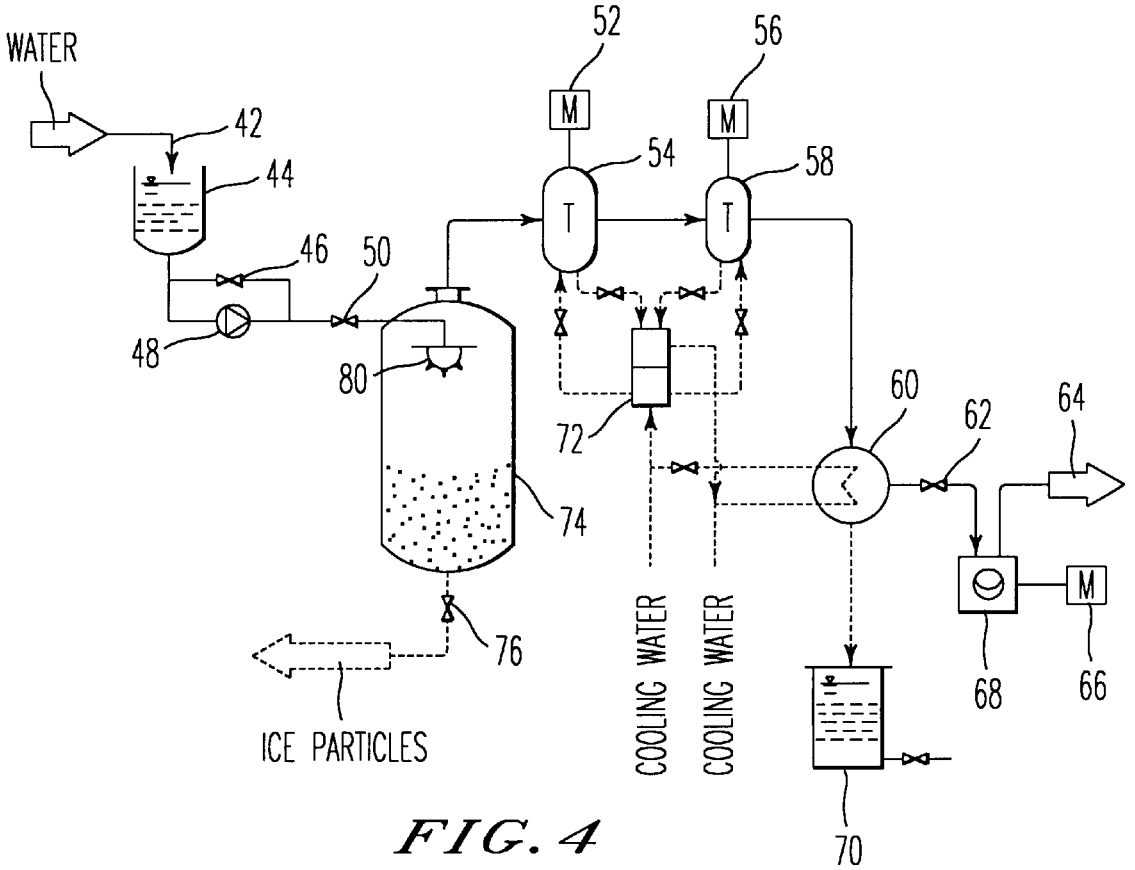
FIG. 4 is a schematic of an embodiment of the ice-making apparatus according to the present invention.

As shown in FIG. 4, one embodiment of the apparatus for making ice particles according to the present invention comprises: a tank (44) for holding water; a vacuum chamber (74) within which the ice particles are formed from water droplets; a pump (48) for feeding water from the holding tank into the vacuum chamber; multiple nozzles (80) for converting the stream of water fed into the vacuum chamber into a spray of water droplets; first and second boosters (54 and 58), respectively, for discharging water vapor that vaporizes from the water droplets in the vacuum chamber and for compressing the vapor thereby discharged; a condenser (60) for condensing the compressed water vapor; and a vacuum pump (68) for removing noncondensable gases from the condenser.

Water is fed from a source, such as a tap, into a holding tank (44) connected to a water pump (48). The pump (48) feeds water from the tank (44) through a valve (50) to multiple nozzles (80) arrayed within an upper part of a vacuum chamber (74) which is maintained at a predetermined pressure. The multiple nozzles (80) generate (from the stream of water being fed to the vacuum chamber (74) by the feed pump) a spray of spherical water droplets, which have a diameter about 80 $\mu$m. Preferably, the diameters of water droplets are within the range of 80 $\mu$m to 500 $\mu$m. Further, the pressure within the vacuum chamber is preferably maintained no greater than 3.5 torr.

The upper part of the vacuum chamber (74) is connected to a first booster (54), which extracts water vapor that vaporizes from the water droplets in the vacuum chamber compresses the extracted vapor, and feeds the once-compressed vapor to a second booster (58). The second booster (58) further compresses the once-compressed water vapor and feeds the twice-compressed water vapor to a condenser (60).

Since the energy required to transform water at the surface of the droplets from the liquid to the gaseous state is supplied by the water droplets themselves, the droplets are cooled rapidly as they fall and are transformed into spherical ice particles in a very short time. The ice particles thereby generated are discharged from the lower part of the vacuum chamber.

The condenser (60) condenses the twice-compressed water vapor and the condensate is gravity-fed to a tank (70) under the condenser. A vacuum pump (68) exhausts noncondensable gases from the condenser to the atmosphere. Before the operation of the present invention, the entire apparatus including the vacuum chamber (74) reaches a recommended vacuum pressure, such as 20 torr, by means of the vacuum pump (68). After the vacuum chamber (74) comes to the vacuum pressure, the vacuum pump (68) stop working. At the actual operation of the present invention, the vacuum pump is necessary to operate only intermittently in order to remove noncondensable gases from the condenser (60).

The temperature change of the droplets as they fall within the vacuum chamber, using the relation that the variation of internal energy in a droplet is the heat obtained from surroundings by thermal conduction subtracted from the heat loss by evaporation of a droplet, may be shown to be:

$$\delta T_p = -\frac{12}{\rho_p C_p D_p^2}\left\{\frac{h_{fg} D_v M}{R}\left(\frac{P_a}{T_a} - \frac{P_\infty}{T_\infty}\right) - k_g(T_\infty - T_a)\right\}\delta t$$

wherein $\rho_p$ $C_p$, and $D_p$ are the density, the specific heat at constant pressure, and the diameter of the water droplets, respectively; $h_{fg}$, $D_v$, M, and R are the latent heat of vaporization of water, the diffusion coefficient of water vapor, the molecular weight of water, and the universal gas constant, respectively; $P_a$ and $T_a$ are the pressure and temperature, at the surface of the droplets, respectively; $P_\infty$ and $T_\infty$ are the pressure and temperature of surroundings, respectively; $k_g$ is the coefficient of thermal conduction of water vapor; and $\delta T_p$ is the change in temperature of the droplets during a very small time interval $\delta t$.

Figure 5:
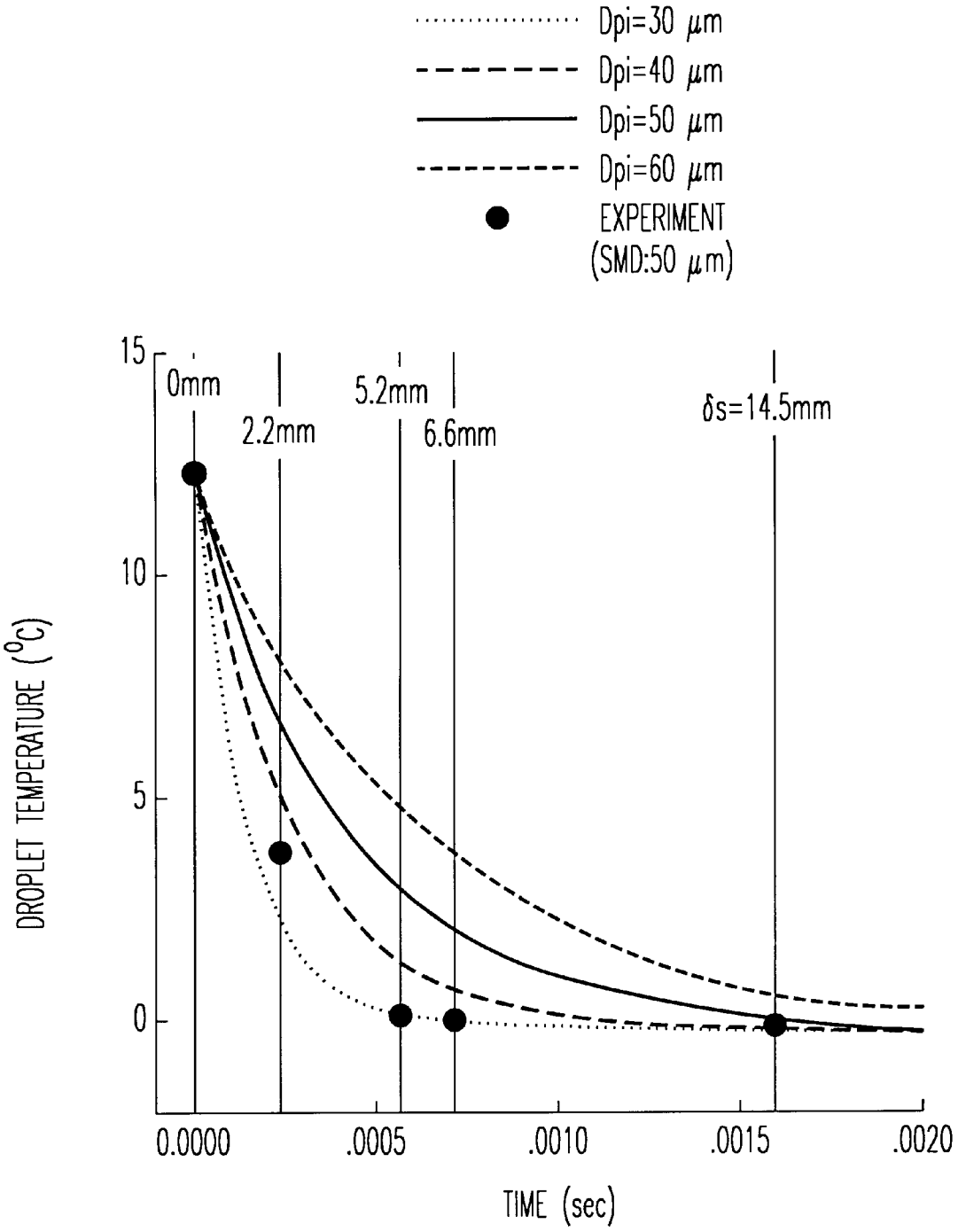
FIG. 5 is a graph showing the theoretical and experimental variation of water droplet temperature with time in a test carried out in the apparatus according to the present invention.

FIG. 5 is a graph comparing the predicted and measured variation of temperature with time for water droplets of diameters 30 $\mu$m to 60 $\mu$m in an apparatus according to the present invention. Theoretical and experimental values agreed with each other relatively well. The cooling rate of the droplets is inversely proportional to the square of the size of the droplets and the time required to transform water droplets of initial diameter 80 $\mu$m into ice particles is within 0.01 sec. considering supercooling of water. For droplets of initial diameter 100 $\mu$m sprayed from the nozzles at a speed of 10 m/s, the time of flight of the droplets within a chamber of height 1.5 m is about 0.15 sec, which is sufficient time to accomplish the desired change of state from liquid to solid.

The boosters can increase the pressure of the vapor being discharged from the vacuum chamber to about 60 torr and thereby increase the saturation temperature of the vapor at the exit of boosters to about 41.4° C. Therefore, the vapor within the condenser can be condensed by means of room temperature cooling water.

With the apparatus of the present invention, ice particles can be produced by using room temperature water as a refrigerant without a conventional refrigeration system. Environmental problems caused by using freon gas as a refrigerant are thereby avoided. Since the ice particles formed are not mixed with brine, a separation process is not needed to recover the ice particles. Since fine spherical ice particles are generated, a process to crush a mass of ice is not needed.

Further, the coefficient of product in the present invention is relatively high, for example 4, because the method of the present invention is similar to the direct contact method which does not need a heat exchanger for making ice particles.

The apparatus of the present invention can be used to rapidly produce spherical ice particles of uniform diameter. Since a mixture of a mass of uniformly-sized, spherical ice particles in water has a viscosity lower than a mixture of the same mass of irregularly-shaped and -sized ice particles in water, the pumping power to transport the former mixture through a heat exchanger is less than that to transport the move the latter mixture. Spherical ice particles of uniform diameter are expected to be less agglomerated than ice particles of nonuniform shape and size.

It will be obvious to those skilled in the art that various modifications of the embodiment of the present invention shown in FIG. 4 and described in detail in the specification may be made without departing from the spirit or scope of the invention.

What is claimed is:

1. An apparatus for making spherical ice particles, the apparatus comprising:

a water feed pump;

a vacuum chamber having at least one nozzle inside thereof, said nozzle connected to said water feed pump for spraying water droplets;

at least one booster connected to said vacuum chamber for discharging water vapor vaporized from the water droplets in the vacuum chamber and for compressing the discharged water vapor, thereby maintaining a predetermined pressure within the vacuum chamber;

a condenser for condensing the water vapor compressed by said booster; and a vacuum pump connected to said condenser for removing noncondensable gases from the condenser.

2. The apparatus according to claim 1, wherein the desired pressure within said vacuum chamber is no greater than 3.5 torr.

3. The apparatus according to claim 1, wherein the water droplets have diameters ranging from 80 $\mu$m to 500 $\mu$m.

4. The apparatus according to claim 2, wherein the water droplets have diameters ranging from 80 $\mu$m to 500 $\mu$m.

5. A method for making spherical ice particles, the method comprising the steps of:

reducing pressure within a vacuum chamber below a predetermined pressure;

feeding water from a water source to at least one spraying nozzle within an upper portion of said vacuum chamber, thereby generating water droplets having diameters less than a predetermined diameter, and water vapor which vaporizes from the water droplets and has a saturation temperature;

discharging water vapor from the vacuum chamber, thereby maintaining pressure within said vacuum chamber below the predetermined pressure;

compressing the discharged water vapor, thereby increasing the saturation temperature of vapor above room temperature;

condensing the compressed water vapor within a condenser at room temperature using water as a coolant; and draining the water being condensed during the condensing step and removing noncondensable gases.

6. The method according to claim 5, wherein the pressure is no greater than 3.5 torr.

7. The method according to claim 5, wherein the water droplets have diameters which range from 80 $\mu$m to 500 $\mu$m.

8. The method according to claim 5, wherein the pressure of the vapor in said compressing step is raised up to 60 torr.

* * * * *